US005916851A

United States Patent [19]

Hosonuma et al.

[11] Patent Number: 5,916,851

[45] **Date of Patent: *Jun. 29, 1999**

[54] LUBRICATING OIL FOR INTERNAL COMBUSTION ENGINE COMPRISING OXYMOLYBDENUM DITHIOCARBAMATE SULFIDE

[75] Inventors: Kunihiko Hosonuma; Yasushi Naitoh; Toru Imori; Kouichi Nakamura, all of Saitama-ken, Japan

[73] Assignee: Japan Energy Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/894,712

[22] PCT Filed: Dec. 24, 1996

[86] PCT No.: PCT/JP96/03760

§ 371 Date: Aug. 11, 1997

§ 102(e) Date: Aug. 11, 1997

[87] PCT Pub. No.: WO97/23587

PCT Pub. Date: Jul. 3, 1997

[30] Foreign Application Priority Data

Dec. 22, 1995 [JP] Japan ..... 7-349563
Feb. 5, 1996 [JP] Japan ..... 8-040306

[51] Int. Cl.[6] ..... C10M 139/00; C10M 141/12

[52] U.S. Cl. ..... 508/363; 508/364; 508/365

[58] Field of Search ..... 508/363, 364, 508/365

[56] References Cited

U.S. PATENT DOCUMENTS

| | | | |
|---|---|---|---|
| 3,133,020 | 5/1964 | Scott | 508/363 |
| 4,501,678 | 2/1985 | Katayama et al. | 508/364 |
| 4,846,983 | 7/1989 | Ward, Jr. | 508/363 |
| 5,356,547 | 10/1994 | Arai et al. | 508/364 |
| 5,627,146 | 5/1997 | Tanaka et al. | 508/363 |
| 5,631,213 | 5/1997 | Tanaka et al. | 508/363 |
| 5,665,684 | 9/1997 | Arai et al. | 508/363 |
| 5,672,572 | 9/1997 | Arai et al. | 508/364 |

FOREIGN PATENT DOCUMENTS

| | | |
|---|---|---|
| 62-81396 | 4/1987 | Japan . |
| 3-23595 | 1/1991 | Japan . |
| 8-186787 | 7/1993 | Japan . |
| 8-336592 | 12/1994 | Japan . |
| 8-20786 | 1/1996 | Japan . |
| 8-253785 | 10/1996 | Japan . |
| 9428094 | 12/1994 | WIPO . |
| 9428095 | 12/1994 | WIPO . |

*Primary Examiner*—Jerry D. Johnson
*Attorney, Agent, or Firm*—McDonnell Boehnen Hulbert & Berghoff

[57] ABSTRACT

There is disclosed a lubricating oil for internal combustion engine which comprises:

a mineral oil and/or a synthetic lubricating oil as a base oil, and oxymolybdenum dithiocarbamate sulfide expressed by the chemical formula (1):

(1)

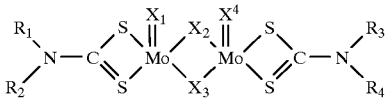

wherein $R_1$ or $R_1$ and $R_3$ denote a branched aliphatic hydrocarbon group having not less than fourteen carbons, and $R_2$ through $R_4$ or $R_2$ and $R_4$ denote an aliphatic hydrocarbon group having not less than four carbons, in the amount of 0.005 to 0.2% by weight, when calculated as molybdenum (Mo).

17 Claims, No Drawings

LUBRICATING OIL FOR INTERNAL COMBUSTION ENGINE COMPRISING OXYMOLYBDENUM DITHIOCARBAMATE SULFIDE

This application is a 371 of PCT/JP96/03760 filed Dec. 24, 1996.

BACKGROUND OF THE INVENTION

1. Field of the Invention

The present invention relates to a composition of a lubricating oil for internal combustion engine such as an engine oil for gasoline automobiles. More particularly, the present invention relates to a lubricating oil for internal combustion engine which can retain the fuel-saving effect for a longer period of time.

2. Related Art

From a viewpoint of suppression of $CO_2$ content in the atmosphere which is considered one of the causes for making the earth warmer as well as resource-saving, the engine oils for the gasoline automobiles (hereinafter referred to briefly as "engine oil") have been strongly required to possess low fuel economy in addition to performances such as wear resistance, oxidation stability, detergency and dispersancy.

Ordinarily, the engine oil is composed of a mineral oil purified from petroleum, or a synthetic lubricating oil such as α-olefin oligomer and ester, added with additives such as a detergent, a dipersant, an antioxidant, an anti-wear agent, and a viscosity index improver. In order to increase the fuel efficiency, it is effective to lower the viscosity of the engine oil. However, mere lowering of the viscosity increases a boundary lubricating area, which leads to increase in friction in some cases. For this reason, a friction modifier (FM) has recently come to be added to the engine oil so as to reduce friction in the boundary lubricating area. Among friction modifiers, organometallic additives are more effective than ashless additives such as ester, amine and amide additives. It is known that, among these, organic molybdenum compounds such as molybdenum dithiocarbamate (MoDTC) and oxymolybdenum organo phosphorodithioate sulfide (MoDTP) are highly effective as described in Japanese Patent Publication of Examined Applications (JP45-B) No.3-23595. It is also reported that the use of MoDTC together with zinc dithiophosphate (ZnDTP) affords the higher friction decreasing effect.

However, the use of the engine oil in the course of time is accompanied by deterioration of and consumption of MoDTC. Therefore, there is a problem that, although a fresh engine oil gives a high fuel economy, such a high fuel economy of the engine oil is deteriorated with the lapse of time. In order to solve the above problem, it can be considered that the addition amount of MoDTC in a fresh oil is increased. However, since MoDTC having a relatively short alkyl group has in general lower solubility, the increase in the addition amount reduces the storage stability. On the other hand, since MoDTC having a relatively long alkyl group has higher solubility but lower thermal resistance, it can hardly be used for a longer period of time.

Accordingly, the object of the present invention is to provide a lubricating oil for internal combustion engine which retains friction loss thereof at lower level even after long use without occurrence of a precipitate derived from MoTDC produced by a new process prior to use, suppress the precipitation of MoDTC and the occurrence of sludge at lower level, and produces no deterioration as to quality even when stored for a longer period of time.

DISCLOSURE OF THE INVENTION

Having made strenuous investigation to accomplish the above-mentioned object, the present inventors discovered that the use of the predetermined amount of oxymolybdenum dithiocarbamate sulfide having the particular structure can remarkably improve the duration of low fuel economy and can afford stable use even after long use and storage, which resulted in completion of the present invention.

That is, in a first embodiment the invention provides a lubricating oil for internal combustion engine that (a) contains a mineral oil and/or a synthetic lubricating oil as a base oil, and (b) contains oxymolybdenum dithiocarbamate sulfide expressed by the following chemical formula (1):

(1)

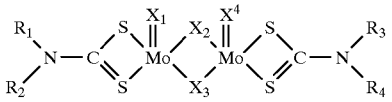

wherein $R_1$ denotes a branched aliphatic hydrocarbon group having not less than fourteen carbons and $R_2$ through $R_4$ denote an aliphatic hydrocarbon group having not less than four carbons, in the amount of 0.005 to 0.2% by weight, when calculated as molybdenum (Mo).

In the above formula (1), $X_1$ through $X_4$ denote oxygen atom or sulfur atom and may be identical with or different from each other.

Preferably, the lubricating oil contains oxymolybdenum dithiocarbamate sulfide wherein $R_1$ and $R_3$ denote a branched aliphatic hydrocarbon group having not less than fourteen carbons and $R_2$ and $R_4$ denote an aliphatic hydrocarbon group in the above chemical formula (1), in the amount of 0.005 to 0.2% by weight, when calculated as molybdenum (Mo).

In a second embodiment, the invention provides a lubricating oil that (a) contains a mineral oil and/or a synthetic lubricating oil as a base oil, and (b) contains oxymolybdenum dithiocarbamate sulfide expressed by the above chemical formula (1) and wherein $R_1$ denotes an aliphatic hydrocarbon group having a branch at β-position and not less than ten carbons and $R_2$ through $R_4$ denote an aliphatic hydrocarbon group having less than four carbons, in the amount of 0.005 to 0.2% by weight, when calculated as molybdenum (Mo).

In this embodiment, the lubricating oil preferably contains oxymolybdenum dithiocarbamate sulfide wherein $R_1$ and $R_3$ denote an aliphatic hydrocarbon group having a branch at β-position and not less than ten carbons and $R_2$ through $R_4$denote an aliphatic hydrocarbon group having less than four carbons in the above chemical formula (1), in the amount of 0.005 to 0.2% by weight, when calculated as molybdenum (Mo).

In any of the foregoing embodiments, the lubricating oil preferably also contains zinc dithiophosphate in the amount of 0.01 to 0.2% by weight, when calculated as phosphorus (P).

In any of the foregoing embodiments, the lubricating oil preferably also contains a sulfur additive in the amount of 0.01 to 0.5% by weight, when calculated as sulfur (S).

In any of the foregoing embodiments, the lubricating oil preferably also contains a phenolic antioxidant having an ester group in the amount 0.2 to 5% by weight.

In either of embodiments 1 or 2, the lubricating oil further contains oxymolybdenum dithiocarbamate sulfide wherein $R_1$ or $R_1$ and $R_3$have a side chain having not less than four carbons at carbon atom from the second to fifth carbon atom from carbon atom, on the chain end, which binds to nitrogen in the above chemical formula (1).

DETAILED DESCRIPTION OF THE INVENTION

[Base oil] The base oil to be used in the present invention is a mineral oil of a lubricating cut or a synthetic oil. As the base oil, which is used as a base component occupying a great part of the lubricating composition, any lubricating base oil may be used. It is preferable that a base oil having viscosity index of not less than 135 is used in order to obtain particularly preferred friction lowering effect.

Specifically, as the mineral oil, use may be made of a lubricant base oil which is produced by obtaining a cut through distilling an ordinary pressure distillation residue of such as a paraffinic crude oil under reduced pressure, treating the resulting cut through extraction with a solvent such as furfural, purification by hydrogenation and dewaxing with a solvent such as MEK or toluene, a lubricant base oil produced by obtaining a deasphalted oil by deasphalting the above pressure-reduced distillation residue and treating it by any of the above appropriate processes, a highly purified base oil obtained through isomerization of slack wax and dewaxing an appropriate cut of the isomerized oil with a solvent of MEK or toluene, or an appropriate mixture thereof.

As the synthetic oil, use may be made of an α-olefin oligomer, a diester synthesized from a dibasic acid such as adipic acid and a primary alcohol, a polyol ester synthesized from a higher alcohol such as neopentyl glycol, trimethylol propane or pentaerythritol and a monobasic acid, alkyl benzene or polyoxyalkylene glycol or an appropriate mixture thereof. Further, needless to say, a mixed oil obtained by appropriately combining the mineral oil with the synthetic oil may be used as the base oil in the present invention.

[Oxymolybdenum dithiocarbamate sulfide] The oxymolybdenum dithiocarbamate sulfide (MoDTC) to be used in the present invention is expressed by the following formula (1):

(1)

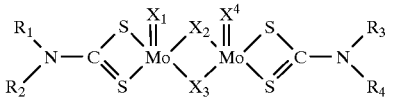

wherein $X_1$ through $X_4$ denote oxygen atom or sulfur atom and may be identical with or different from each other.

In the formula, $R_1$ or $R_1$ and $R_3$ denote a branched aliphatic hydrocarbon group having not less than fourteen carbons or an aliphatic hydrocarbon group having a branch at β-position and not less than ten carbons. It is preferable that $R_1$ or $R_1$ and $R_3$ denote an aliphatic hydrocarbon group having a branch at β-position and not less than fourteen carbons, in particular, a primary alkyl group from a viewpoint of thermal stability. It is preferably that the number of carbons is ten through thirty six, in particular, fourteen through twenty four. When the number of carbons is less than the above-mentioned range, the solubility is not sufficient. On the other hand, when the number of carbons is more than the above-mentioned range, the content of molybdenum becomes relatively lower. For these reasons, deviation from the above-mentioned range is not preferable.

The position of a branch in this branched aliphatic hydrocarbon group is preferably such that the group has a side chain at the second to fifth carbon atom from carbon atom, on the chain end, which binds to nitrogen. It is most preferable that the group has a side chain at the second carbon atom (that is, β-position). This is because oxydithiocarbamate sulfide is prone to degrade and is not stable when the group has a branch at α-position (for example, secondary alkyl group and the like) or the group is straight-chain. In addition, when the group has a short branch at an end, the situations are almost the same as those in a case of the above-mentioned straight-chain, being not preferable.

As the side chain, an alkyl group having one to sixteen carbons is preferable. It is particularly preferable that the number of carbons in the side chain is almost equal to that in the main chain, more specifically, the number of carbons in the side chain is in the range of {(n−2)/2} to {(n−6)/2} when the number of carbons of $R_1$ (or $R_3$) is n. Preferable examples thereof include 2-hexyldecyl group, 2-heptylundecyl group, 2-octyldodecyl group, and 2-decyltetradecyl group in which the number of carbons in the side chain is {(n−4)/2).

In the formula, $R_2$ through $R_4$ or $R_2$ and $R_4$ other than aforementioned $R_1$ or $R_1$ and $R_3$ denote an aliphatic hydrocarbon group having not less than four carbons, preferably a branched aliphatic hydrocarbon group having four to twelve carbons, particularly preferably a branched alkyl group having a branch at β-position and four to ten carbons from a viewpoint of thermal stability. Preferable examples thereof include 2-ethylhexyl group, and 2-methylbutyl group.

The aliphatic hydrocarbon groups herein are preferably hydrocarbon groups such as alkyl group, cycloalkyl group and alkenyl group, optionally containing an ester group, an ether group, an alcohol group, or a carboxyl group. In addition, in the formula, $X_1$ through $X_4$ denote oxygen atom or sulfur atom. Preferably, the ratio between the number of oxygen atom or atoms and that of sulfur atom or atoms in $X_1$ through $X_4$ is 1/3 to 3/1.

The addition amount of MoDTC relative to total weight of the lubricating oil is in such a range that MoTDC dissolves in the base oil and is 0.005 to 0.2% by weight, preferably 0.02 to 0.15% by weight, more preferably 0.03 to 0.10% by weight, when calculated as molybdenum (Mo). When the addition amount is less than 0.005% by weight, the friction-reducing effect is small, whereas when it is more than 0.2% by weight, the friction-reducing effect becomes saturated and the cost increases. In addition, MoDTC's wherein four hydrocarbon groups $R_1$, $R_2$, $R_3$ and $R_4$ are not within the aforementioned definition may be added as long as they give no adverse influence on the effect of the present invention.

By the way, in some cases, oxymolybdenum dithiocarbamate (MoDTC) is expressed by the following structures:

(A)

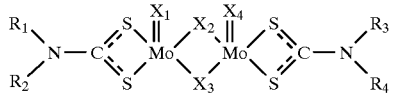

-continued (B)

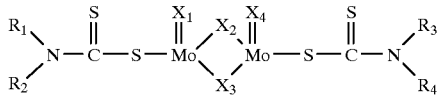

This is derived from whether the bonds among C—$S_2$—Mo are construed as Kelule structure or double bond one. The structure is a theoretical problem and which one is the actual structure dose not affect on the present invention.

[Preparation of MoDTC] As a method for preparing oxymolybdenum dithiocarbamate sulfide (MoDTC), there is generally known a method, as disclosed in JA-P 62-81396, in which (a) molybdenum trioxide or an alkaline metal salt or ammonium salt of molybdic acid, (b) alkali hydrosulfide or alkali sulfide expressed by the general formula $M_2S$ (M denotes alkaline metal or ammonium group), (c) carbon disulfide, and (d) secondary amine are reacted. In this case, four hydrocarbon groups $R_1$, $R_2$, $R_3$ and $R_4$ in molybdenum dithiocarbamate are decided depending upon the hydrocarbon group in the secondary amine. As a method for preparing the secondary amine, there are known a reaction of halogenated alkyl and ammonia or primary amine, and a reaction of alcohol and primary amine.

However, in MoDTC used in the present invention, one of two hydrocarbon groups which bind to one nitrogen element is a long chain, for example, a chain having not less than fourteen carbons and the other hydrocarbon group is a short chain, for example, a chain having not more than ten carbons (hereinafter also referred to as "partial long chain MoDTC"). The synthesis of such the partial long chain MoDTC is difficult for the following reason.

In order to synthesize partial long chain MoDTC, the corresponding secondary amine is required. When the secondary amine is synthesized by reacting halogenated alkyl or alcohol and ammonia, a primary amine and a tertiary amine are also contained in addition to the secondary amine and, as a combination of hydrocarbon groups, that of a long chain and a long chain and that of a short chain and a short chain are contained in addition to that of a long chain and a short chain. In addition, with respect to purification of the secondary amine, in a case of the relatively small number of carbons, for example, in a case of the total carbon number of not more than sixteen, a desired secondary amine can be purified by distillation or the like. However, secondary amines having the relatively large number of carbons, for example, the total carbon number of not less than eighteen, in particular not less than twenty two are difficult to be isolated due to higher boiling point and a small difference in boiling points. Therefore, the desired partial long chain MoDTC is difficult to be effectively prepared.

Then, in order to effectively obtain the desired MoDTC at a higher purity with the small amount of side product MoDTC having the different hydrocarbon group part structure from that of the desired MoDTC, it is preferable that partial long chain MoDTC is prepared by (a) synthesizing a secondary amine from a hydrocarbon derivative having halogen, hydroxy group, sulfonic acid group or nitro group and a primary amine as a raw material,then (b) reacting the secondary amine, a metal source and a sulfur and carbon source.

According to this preparation method, the secondary amine having the required structure can be obtained without side production of amines other than the desired one, by using a hydrocarbon derivative having a hydrocarbon part of the predetermined structure and a primary amine having a hydrocarbon group of the predetermined structure. This secondary amine can be used as a raw material to effectively prepare partial long chain MoDTC.

In this preparation method, as the hydrocarbon derivative as a raw material for the secondary amine, use may be made of the derivatives having halogen, hydroxy group, sulfonic acid group or nitro group as a substituent. It is preferably that halogenated alkyl is used due to easy reaction. As the halogenated alkyl, the reactivity increases in the order of fluoride, chloride, bromide and iodide. In a viewpoint of easy handling, chloride is preferable. Examples of the preferable compounds include the chlorides having a branched alkyl group, such as 2-hexyldecyl chloride, 2-heptylundecyl chloride, 2-octyldecyl chloride, and 2-decyltetradecyl chloride.

As the primary amine used in this preparation method, the amines having a branched alkyl group such as 2-ethylhexylamine and 2-methylbutylamine are preferable. It is preferable that the number of carbons in an alkyl group in alkyl primary amine is less than that in the alkyl derivative because purification of the primary amine is easy. A secondary amine in this preparation method is obtained from a reaction of the aforementioned hydrocarbon derivative and a primary amine. When a reaction of halogenated alkyl and alkyl primary amine is used, it is preferable that the molar rate of halogenated alkyl and alkyl primary amine is 1:1 to 1:5, particularly 1:1.2 to 1:4, and a reaction temperature is 50 to 250° C., particularly 150 to 200° C. in a viewpoint of yield and reaction efficacy. As a solvent upon reaction, solvents such as halogenated compounds and hydrocarbons are appropriately used. However, even when no solvent is used, a reaction proceeds. After reaction, unreacted raw materials and the like are removed by distillation or the like. However, a step of removing a side product amine is not necessarily required.

In this preparation method, MoDTC is synthesized by reacting a metal source, a sulfur and carbon source and a secondary amine in an aqueous solution or in an organic solvent. In the reaction in an aqueous solution, pH is preferably 1 to 13, particularly 1.5 to 3.5, and an acid such as sulfuric acid and hydrochloric acid is added as necessary. A reaction temperature is preferably 60° C. to 110° C., particularly 95° C. to 105° C. The molar ratio of the secondary amine and the metal source is preferably 1:0.8 to 1:3, particularly 1:0.9 to 1:2.5. When the metal source is excessively contained, the removal of the unreacted materials becomes complicated. It is preferable from a viewpoint of impurity removal, particularly improvement in performances as a lubricant additive that a solvent is removed after the reaction, and a dithiocarbamate salt is purified with an adsorbing agent such as silica gel. Alternatively, the synthesis can be conducted in an organic solvent such as N,N'-dimethylformamide.

As the metal source used in the aforementioned synthesis, various metallic compounds which can dissolve in a solvent upon the reaction can be used. In a case of MoDTC, molybdenum trioxide, alkaline metal salt of molybdic acid or ammonium salt of molybdic acid can be used as the metal source. As the sulfur and carbon source to be reacted with the metal source and the secondary amine, sulfide such as alkali sulfide such as sodium sulfide, ammonium sulfide, and alkali hydrosulfide such as sodium hydrosulfide as well as carbon disulfide are preferably used.

The aforementioned method of preparing partial long chain MoDTC can be also applied to dithiocarbamate salts other than molybdenum dithiocarbamate. In general, a dithiocarbamate salt is expressed by the following chemical formula (2).

(2)

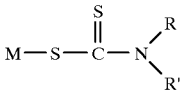

In the formula, M denotes a metal element such as molybdenum, tungsten, titanium, lead, zinc and copper, and R and R' denote hydrocarbon groups, such as alkyl group and aryl group, which have the different structure. A mode of binding between the metal element and sulfur may be different depending upon the metal element. Usually, the number of carbons in hydrocarbon groups R and R' is preferably 4 to 28. The dithiocarbamate salt is preferably used as an additive for a lubricating oil, or a vulcanization accelerator for latex and rubber. This preparation method is preferably used when the total carbon number in hydrocarbon groups R and R' is not less than eighteen, particularly not less than twenty two or when hydrocarbon groups R and R' are alkyl group, particularly branched alkyl group.

[Zinc dithiophosphate] It is preferably that zinc dithiophosphate (ZnDTP) expressed by the following formula (3) is further added.

(3)

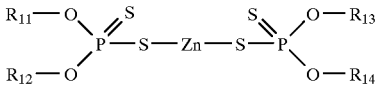

In the formula, $R_{11}$, through $R_{14}$ denote a hydrocarbon group such as straight-chain or branched-chain alkyl group having the average carbon number of not less than three and aryl group. As $R_{11}$ through $R_{14}$, the alkyl groups having three to eighteen carbons are preferable. Specifically, mention may be made of propyl group, butyl group, pentyl group, hexyl group, octyl group, and lauryl group. $R_{11}$ through $R_{14}$ may be identical with or different from each other.

The addition amount of ZnDTP relative to total weight of the lubricating oil is 0.01 to 0.2% by weight, preferably 0.04to 0.2% by weight, most preferably 0.04to 0.15% by weight, when calculated as phosphorus (P). In this range, the higher wear-preventing performance derived from synergistic effect with MoDTC can be obtained. When the amount is more than 0.2% by weight, influence of the phosphorus component upon catalytic activity for the exhaust gas becomes greater.

[Sulfur additive] It is preferable that a sulfur additive is further added. As the sulfur additive, use may be made of extreme pressure agents such as sulfurized oils or fats, sulfides, thiocarbonates, and metal thiocarbamate. Specifically, use may be made of sulfurized sperm oil, sulfurized pinene oil, sulfurized soybean oil, sulfurized polyolefin, dialkyl disulfide, dialkyl polysulfide, dibenzyl disulfide, ditertiarybutyl disulfide, polyolefin polysulfide, bisalkylpolysulfanylthiadiazole, sulfurized phenol, and dithiocarbamate of metal such as zinc, lead and In particular, zinc dithiocarbamate (ZnDTC) expressed by the following chemical formula (4) and thiadiazole type polysulfide compound expressed by the following chemical formula (5) are preferably used.

(4)

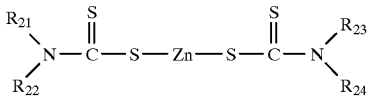

In the formula, $R_{21}$ through $R_{24}$ denote hydrocarbon groups such as alkyl group having the average carbon number of not less than six, cycloalkyl group, aryl group, alkylaryl group, arylalkyl group and alkenyl group, optionally containing an ester group, an ether group, an alcohol group, or a carboxyl group. Preferably, the alkyl groups having the average carbon number of eight to eighteen are used. Specifically, mention may be made of 2-ethylhexyl group, isotridecyl group, and octadecyl group (stearyl group). Usually, $R_{21}$, through $R_{24}$ having the same structure are used. When $R_{21}$ through $R_{24}$have the predetermined average carbon number, ZnDTC's having the different structures may be mixed. Since when DTC of a metal other than zinc such as lead is used, a part of the engine oil is combusted and contained in the exhaust gas, it is not preferable from an environmental point of view.

(5)

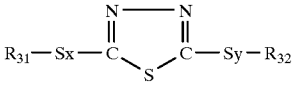

In the formula, $R_{31}$, and $R_{32}$ denote a hydrocarbon group such as alkyl group having the average carbon number of not less than three, cycloalkyl group, aryl group, alkylaryl group, arylalkyl group and alkenyl group, optionally containing an ester group, an ether group, an alcohol group, or carboxyl group. Preferably, alkyl groups having the average carbon number of three to eighteen are used. Specifically, mention may be made of octyl group, nonyl group, and dodecyl group. Usually, $R_{31}$, and $R_{32}$ having the same structure are used. When $R_{31}$, and $R_{32}$ have the predetermined average carbon number, polysulfide compounds having the different structures may be mixed. "x" and "y" denote an integer of two to five, usually two to three.

The addition amount of the sulfur additive relative to total weight of the lubricating oil is 0.01 to 0.5% by weight, preferably 0.05 to 0.4% by weight, more preferably 0.07 to 0.3% by weight, when calculated as sulfur (S). When the addition amount is less than 0.01% by weight, life-prolonging effect is small. On the other hand, even when the amount is more than 0.5% by weight, the intended effect becomes saturated. In addition, when MoDTC and ZnDTC wherein $R_{21}$ through $R_{24}$ have the average carbon number of less than six are present together in the lubricating oil, the lubricating oil becomes turbid and the-storage stability is deteriorated and, thus, the lubricating is unsuitable as a lubricating oil for internal combustion engine in some cases.

[Antioxidant] In the present invention, a phenolic antioxidant having an ester group is preferably used, a representative of which is expressed by the following chemical formula (6). In order to lessen the sublimation at an elevated temperature upon use as the engine oil, a molecular weight of this antioxidant is preferably not less than 300.

(6)

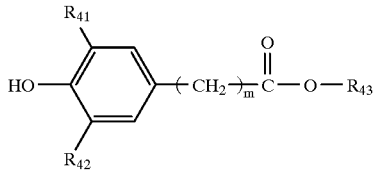

wherein m denotes an integer of one to three.

In the formula, $R_{41}$ and $R_{42}$ denote an alkyl group having one to twelve carbons, a branched alkyl group having three to eight carbons being preferable. $R_{43}$ denotes a hydrocarbon group such as alkyl group having four to fifty carbons, cycloalkyl group, aryl group, alkylaryl group, arylakyl group and alkenyl group, optionally containing an ester group, an ether group, an alcohol group, or a carboxyl group. Preferably, alkyl groups having six to sixteen are used. $R_{41}$ and $R_{42}$ may be identical with or different from each other. Alternatively, a mixture of two or more antioxidants having different $R_{41}$ through $R_{43}$ may be used.

The addition amount of this antioxidant relative to total weight of the lubricating oil is 0.2 to 5% by weight, preferably 0.5 to 2% by weight. When the addition amount is less than 0.2% by weight, the oxidation-preventing effect is small. On the other hand, even when the antioxidant is added in the amount of more than 5% by weight, the oxidation-preventing effect becomes saturated and the cost increases.

[Other additives] In order to ensure the performance suitable for the intended use, lubricant oil additives other than the above may be appropriately added to the lubricating oil for internal combustion engine according to the present invention so as to improve the total performance. As such engine oil additives, mention may be made of so-called metallic detergencies such as sulfonate, phenate and salicylate of alkaline earth metals such as Ca, Mg and Ba and alkaline metals such as Na, ashless dispersants such as alkenyl succinic acid imide, succinic acid esters, succinic acid amide and benzylamine, and viscosity index improvers such as olefin copolymer or polymethacrylate. In addition, additives such as a pour point depressant, anti-corrosion agent and antifoaming agent may be appropriately added. In addition, phenolic antioxidants other than that having an ester group, and amine antioxidant such as diphenylamine may be appropriately added.

(EXAMPLES)

The present invention will be explained in more detail with reference to Examples and Comparative Examples. First, partial long chain MoDTC to be used in the present invention is prepared.

[Synthesis of 2-hexyldecanyl chloride] 240 g (0.99 mol) of 2-hexyldecanol and 900 mL of chloroform were placed into a 3 L three-neck flask equipped with a reflux condenser and an addition funnel, 120 mL (1.6 mol) of thionyl chloride was added dropwise for 70 minutes, which was stirred at room temperature for 1 hour, and 130 mL (0.16 mol) of pyridine was added, which was stirred at room temperature for 1 hour and further at 75° C. for 5 hours. After completion of the reaction, the mixture was washed with 2 L of water, and the organic layer was dried with anhydrous sodium sulfate. The solvent contained in the resultant brown liquid was distilled off, followed by distillation under reduced pressure to obtain 150 g (0.58 mol) of pale yellow liquid. Yield was 59%.

[Synthesis of secondary amine] 5.0 g (0.019 mol) of 2-hexyldecanyl chloride and 5.0 g (0.039 mol) of 2-ethylhexylamine were placed into a 100 mL one-neck flask equipped with a reflux condenser, followed by stirring at 180° C. for 11 hours. Since secondary amine hydrochloride was formed by the reaction, this was washed with an alkali, and distilled under reduced pressure to obtain 5.9 g of pale yellow liquid. Yield of the (2-hexyldecanyl) (2-ethylhexyl)amine was 85%.

[Synthesis 1 of MoDTC] 5.1 g(0.021 mol) of $Na_2MoO_4.2H_2O$, 5.1 g (0.021 mol) of $Na_2S.\ 9H_2O$ and 7 mL of water were placed into a 100 mL one-neck flask, pH of the mixture was brought to 2.5 with 20% aqueous sulfuric acid. After stirred at room temperature for 30 minutes, 5.0 g (0.014 mol) of (2-hexyldecanyl) (2-ethylhexyl)amine and 1.1 g (0.14 mol) of carbon disulfide were added thereto, which was sealed, followed by stirring at room temperature for 1 hour. Thereafter, the one-neck flask was equipped with a reflux condenser, followed by stirring at 105° C. for 5 hours. After completion of the reaction, the reaction was dissolved in 100 mL of toluene, the solution was washed with 300 mL of water, the organic layer was dried with anhydrous sodium sulfate, and the solvent was distilled off, followed by purification with a silica gel column to obtain 6.6 g of yellow-green viscous liquid (Synthesis 1).

[Synthesis 2 of MoDTC] 24 g (0.17 mol) of $MoO_3$, 63 g of an 15 to 18% aqueous solution of sodium hydrosulfide and 200 mL of water were placed into a 500 mL flask, and pH of the mixture was brought to 3.0 with 20% aqueous sulfuric acid. After stirred at room temperature for 30 minutes, 60 g (0.17 mol) of (2-hexyldecanyl) (2-ethylhexyl) amine and 14 g (0.181 mol) of carbon disulfide were added. After completion of the reaction, 500 mL of toluene was added, which was sealed, and the organic layer was washed with 1000 mL of water. The organic layer was extracted, dried with anhydrous sodium sulfate, the solvent was distilled off, the residue was purified using silica gel, washed with butyl alcohol, and dried under reduced pressure to obtain 60 g of brown-yellow viscous liquid (Synthesis 2).

[Analysis of MoDTC] The results of elementary analysis on MoDTC obtained from Synthesis 1 were as follows: Mo, 16.8% by weight; S, 16.7% by weight; N, 2.35% by weight. Theoretical values for $C_{50}H_{100}N_2S_4Mo_2O_4$ are as follows: Mo, 16.8% by weight; S, 16.8% by weight; N, 2.45% by weight. In addition, from the results of $^{13}C$-NMR analysis, a single peak (208.7 ppm) derived from the dithiocarbamate structure was confirmed.

The results of elementary analysis on MoDTC obtained from Synthesis 2 were as follows: Mo, 17.4% by weight; S, 19.4% by weight; N, 2.35% by weight. In addition, from the results of $^{13}C$-NMR analysis, a single peak (208.7 ppm) derived from the dithiocarbamate structure was confirmed.

From the above steps, MoDTC expressed by the chemical formula (1) and wherein $R_1$ and $R_3$ denote 2-hexyldecyl group, $R_2$ and $R_4$ denote 2-ethylhexyl group (hereinafter referred to as "MoDTC-1") was prepared. Similarly, MoDTC expressed by the chemical formula (1) (hereinafter referred to as "MoDTC-2") was prepared according to the same manner as mentioned above except that a secondary amine obtained by mixing (2-hexyldecanyl) (2-ethylhexyl) amine and di(2-ethylhexyl)amine in the equal amount was used in place of (2-hexyldecanyl) (2-ethylhexyl)amine. The ratio of oxygen atom and sulfur atom in $X_1$ through $X_4$ in these MoDTC's is approximately 1.

Using these MoDTC'S, test oils 1 to 8 were prepared as the engine oil of Examples and Comparative Examples. As the base oil, mineral oils 1 to 2 having the properties shown in Table 1 were used.

TABLE 1

| | Mineral oil 1 | Mineral oil 2 |
|---|---|---|
| Density (15° C.) [g/cm$^3$] | 0.862 | 0.821 |
| Dynamic viscosity (40° C.) [mm$^2$/s] | 17.7 | 19.7 |
| Dynamic viscosity (100° C.) [mm$^2$/s] | 3.78 | 4.51 |
| Viscosity index [–] | 99 | 147 |
| Pour point [° C.] | –15.0 | –15.0 |
| Content of saturated component [%] | 76.5 | 98.8 |

As additives, the following were used.

MoDTC-A: Commercially available MoDTC, wherein $R_1$ through $R_4$ denote 2-ethylhexyl group in the chemical formula (1).

MoDTC-B: Commercially available MoDTC, wherein $R_1$ through $R_4$ denote an alkyl group having thirteen carbons in the chemical formula (1).

ZnDTP: ZnDTP expressed by the chemical formula (3), wherein $R_{11}$, through $R_{14}$ denote 2-ethylhexyl group.

ZnDTC: ZnDTC expressed by the chemical formula (4), wherein $R_{21}$ through $R_{24}$ denote 2-ethylhexyl group.

The above mentioned base oils and additives were mixed at the ratio shown in Tables 2 and 3 to prepare test oils of Examples and Comparative Examples. The mixing ratio is expressed as % by weight relative to weight of the lubricating oil. In addition, as common additive components, metallic detergencies, ashless dispersant, phenolic antioxidant, amine antioxidant, viscosity index improver, anti-corrosion agent and antifoaming agent were added to these test oils.

TABLE 2

| | Test oil 1 | Test oil 2 | Test oil 3 | Test oil 4 |
|---|---|---|---|---|
| Formulation | | | | |
| Mineral oil 1 [% by weight] | — | 84.5 | — | — |
| Mineral oil 2 [% by weight] | 84.9 | — | 84.9 | 84.4 |
| MoDTC-1 [% by weight] | 0.45 | 0.45 | — | 0.45 |
| MoDTC-2 [% by weight] | — | — | 0.43 | — |
| MoDTC-A [% by weight] | — | — | — | — |
| MoDTC-B [% by weight] | — | — | — | — |
| ZnDTP [% by weight] | 1.2 | 1.2 | 1.2 | 1.2 |
| ZnDTC [% by weight] | — | — | — | 0.55 |
| Dynamic viscosity | | | | |
| at 40° C. [mm$^2$/s] | 42.5 | 47.5 | 42.2 | 42.1 |
| at 100° C. [mm$^2$/s] | 8.37 | 8.25 | 8.31 | 8.29 |
| Element in oil | | | | |
| Mo [Mo % by weight] | 0.08 | 0.08 | 0.08 | 0.08 |
| Phosphorus [P % by weight] | 0.095 | 0.095 | 0.095 | 0.095 |
| Friction coefficient | | | | |
| Fresh oil | 0.046 | 0.047 | 0.045 | 0.046 |
| Used oil | 0.074 | 0.080 | 0.071 | 0.057 |
| Hot tube test [mg] | 60 | 75 | 54 | 25 |
| Storage stability (precipitate/No Precip.) | No Precip. | No Precip. | No Precip. | No Precip. |

TABLE 3

| | Test oil 5 | Test oil 6 | Test oil 7 | Test oil 8 |
|---|---|---|---|---|
| Formulation | | | | |
| Mineral oil 1 [% by weight] | — | 84.6 | — | — |
| Mineral oil 2 [% by weight] | 85.0 | — | 83.6 | 85.2 |
| MoDTC-1 [% by weight] | — | — | — | — |
| MoDTC-2 [% by weight] | — | — | — | — |
| MoDTC-A [% by weight] | 0.38 | 0.38 | — | 0.14 |
| MoDTC-B [% by weight] | — | — | 1.74 | — |
| ZnDTP [% by weight] | 1.2 | 1.2 | 1.2 | 1.2 |
| ZnDTC [% by weight] | — | — | — | — |
| Dynamic viscosity | | | | |
| at 40° C. [mm$^2$/s] | 42.5 | 47.7 | 42.4 | 42.1 |
| at 100° C. [mm$^2$/s] | 8.35 | 8.21 | 8.30 | 8.29 |
| Element in oil | | | | |
| Mo [Mo % by weight] | 0.08 | 0.08 | 0.08 | 0.03 |
| Phosphorus [P % by weight] | 0.095 | 0.095 | 0.095 | 0.095 |
| Friction coefficient | | | | |
| Fresh oil | 0.046 | 0.060 | 0.045 | 0.046 |
| Used oil | 0.075 | 0.082 | 0.140 | 0.140 |
| Hot tube test [mg] | 65 | 79 | 120 | 58 |
| Storage stability (precipitate/No Precip.) | Precipitate | Precipitate | No Precip. | No Precip. |

Test oils 1 to 8 thus prepared were evaluated with respect to wear characteristic, hot tube test and storage stability in fresh oils and used ones. The results thereof are also shown in Tables 2 and 3.

As wear characteristic, the coefficient of friction was measured on fresh oils and used ones. Measurement was conducted using a SRV tester according to the following conditions.

| | |
|---|---|
| Test pieces: | ball and disk made of SUJ-2 having a diameter of 10 mm |
| Test conditions: | |
| Load | 100 N |
| Amplitude | 1.5 mm |
| Frequency | 50 Hz |
| Temperature | 80° C. |
| Time | 20 minutes |

Fresh oils are a lubricating oil immediately after formulated and used ones are a lubricating oil after oxidation stability test on the lubricating oil for internal combustion engine has been conducted according to JIS K2514. Oxidation stability test was conducted at 150° C. for 168 hours.

Thermal resistance was evaluated by hot tube test. The deposit amount was measured at 310° C. using a hot tube tester manufactured by Komatsu Engineering (K.K.). Storage stability was evaluated by determining whether a precipitate occurred or not in a test oil after the test oil in a glass precipitation tube had been stored at 0° C. for one month.

Test oils 1 to 4 of Examples did not produce a precipitate after storage and, thus, have excellent storage stability whereas test oils 5 to 6 of Comparative Examples produced a precipitate. In addition, test oils 1 to 4 did not have deleterious change in friction coefficient even after the oils had been deteriorated and, thus, can retain lower friction coefficient when used for a longer period of time whereas test oils 7 to 8 of Comparative Examples did. Further, test oils 1 to 4 produced small amount of deposit in hot tube test and, thus, have excellent thermal resistance. It is seen that test oil 4 containing a sulfur additive produces smaller amount of deposit.

Further, the above-mentioned base oils and additives were mixed at the ratio designated in Table 4 to prepare test oils 9 and 10 of Example and Comparative Example, respectively. As the additive, the following were used in addition to those used in test oils 1 to 8.

MoDTC-C: Commercially available MoDTC, wherein $R_1$ through $R_4$ denote an alkyl group having thirteen or eight carbons in the chemical formula (1).

Thiadiazole compound: Thiadiazole type polysulfide compound expressed by the chemical formula (5), wherein $R_{31}$ and $R_{32}$ denote an alkyl group having nine carbons and x and y denote an integer of two to five. The content of sulfur in the additive is 36% by weight.

Propionate antioxidant: Phenolic antioxidant, having an ester group, expressed by the chemical formula (6), wherein m denotes two, and $R_{41}$ and $R_{42}$ denote tertiary butyl group, said antioxidant being supplied by Ciba Geigy Co. under the name of Irganox L135.

The remainder components are common additives, including metallic detergency, ashless dispersant, phenolic antioxidant, amine antioxidant, viscosity index improver, anti-corrosion agent and antifoaming agent.

TABLE 4

| | Test oil 9 | Test oil 10 |
|---|---|---|
| Formulation | | |
| Mineral oil 2 [% by weight] | 84.9 | 84.9 |
| MoDTC-1 | | |
| [% by weight] | 0.55 | — |
| [Mo % by weight] | 0.081 | — |
| MoDTC-C | | |
| [% by weight] | — | 2.04 |
| [Mo % by weight] | — | 0.081 |
| ZnDTP | | |
| [% by weight] | 1.2 | 1.2 |
| [P % by weight] | 0.095 | 0.095 |
| Thiadiazole compound | | |
| [% by weight] | 0.2 | 0.2 |
| [S % by weight] | 0.072 | 0.072 |
| Propionate antioxidant [% by weight] | 1.0 | 1.0 |
| Dynamic viscosity | | |
| at 40° C. [$mm^2/s$] | 42.2 | 43.2 |
| at 100° C. [$mm^2/s$] | 8.41 | 8.48 |
| Friction coefficient | | |
| Fresh oil | 0.045 | 0.047 |
| Used engine oil | | |
| After 96 hours | 0.037 | 0.037 |
| After 168 hours | 0.062 | 0.091 |
| Hot tube test [mg] | 27 | 85 |
| Storage stability (precipitate/No Precip.) | No precipitate | No precipitate |

According to the same manner as that in test oils 1 to 8, test oils 9 to 10 thus prepared were evaluated for friction characteristic, hot tube test, and storage stability in fresh oils and used ones. The results thereof are also shown in Table 4. As the used oil, a used oil was employed which was obtained by using a gasoline engine of 2 L series six-cylinder, reducing the amount of an oil pan to 2 L, and subjecting the test oil to durability bench test under an AMA running mode at an oil temperature of 100 ° C. and a water temperature of 100° C. to deteriorate it. Test oil 9 of Example had small deleterious change in friction coefficient even when deteriorated as compared with test oil 10 and, thus, it is understood that test oil 9 can retain lower friction coefficient when used for a longer period of time.

INDUSTRIAL APPLICABILITY

The present invention is a lubricating oil for internal combustion engine, added with the predetermined amount of oxymolybdenum dithiocarbamate sulfide having the particular structure, and which can retain lower friction coefficient when used for a longer period of time, and which has excellent thermal resistance, and excellent storage characteristic and stability. Therefore, the present lubricating oil can be used stably in the internal combustion engines for a longer period of time, and has remarkable fuel-saving effect.

We claim:

1. A lubricating oil for an internal combustion engine comprising:

a mineral oil and/or a synthetic lubricating oil as a base oil, and an oxymolybdenum dithiocarbamate sulfide compound of the chemical formula (1):

(1)

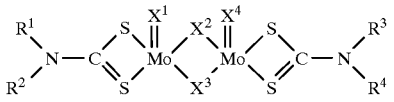

in an amount of 0.005 to 0.2% by weight of molybdenum wherein $X^1$ through $X^4$ are each an oxygen atom or sulfur atom and may be identical or different from each other, $R^1$ is a branched aliphatic hydrocarbon group having not less than fourteen carbons, and $R^2$ through $R^4$ are independently an aliphatic hydrocarbon group having not less than four carbon atoms, and wherein at least one of $R^1$ through $R^4$ is an alkyl of not less than 10 carbons having a branch point at position 2, 3, 4, or 5.

2. The lubricating oil for internal combustion engine as defined in claim 1, wherein $R_1$ and $R_3$ denote a branched aliphatic hydrocarbon group having not less than fourteen carbons, and $R_2$ and $R_4$ denote an aliphatic hydrocarbon atom having not less than four carbons in the chemical formula (1).

3. The lubricating oil according to claim 1 wherein $R^1$ has a side chain with 4 or more carbons, which side chain is at position 2, 3, 4, or 5.

4. The lubricating oil according to claim 3, where $R^1$ has a side chain at the 2 position.

5. The lubricating oil according to claim 1 wherein $R^1$ and $R^3$ each have a side chain of 4 or more carbon atoms, which side chains are at position 2, 3, 4, or 5.

6. The lubricating oil according to claim 5, wherein the side chains are at the 2 position.

7. The lubricating oil according to claim 1, further comprising a sulfur-based additive of the chemical formula (5):

(5)

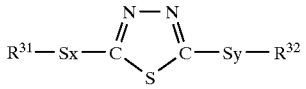

in an amount of 0.01 to 0.5% by weight of sulfur wherein $R^{31}$ and $R^{32}$ independently are a hydrocarbon group having 3–18 carbon atoms and x and y are integers from 2 to 5.

8. The lubricating oil according to claim 7, wherein said sulfur-based additive is added in an amount of 0.07 to 0.3% by weight of sulfur.

9. The lubricating oil according to claim 1, further comprising 0.2 to 5.0% by weight of a phenol-type antioxidant given by the chemical formula (6):

(6)

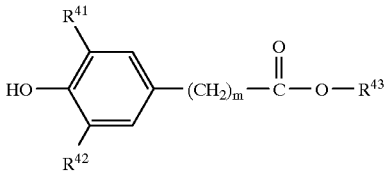

wherein m is an integer from 1 to 3, $R^{41}$ and $R^{42}$ independently are a linear or branched hydrocarbon group having 1 to 12 carbon atoms, and $R^{43}$ is a hydrocarbon group having 4 to 50 carbon atoms.

10. The lubricating oil according to claim 9, wherein said phenol-type antioxidant is present in an amount of 0.5 to 2.0% by weight.

11. The lubricating oil for internal combustion engine according to claim 10, wherein said phenol-type antioxidant has a molecular weight of 300 or more.

12. A lubricating oil according to claim 1, further comprising a sulfur additive in an amount of 0.01 to 0.5% by weight of sulfur.

13. The lubricating oil according to claim 12, wherein the sulfur additive is one or a combination of compounds selected from the group consisting of sulfurized oils, sulfurized fats, sulfides, thiocarbonates, and metal thiocarbonates.

14. The lubricating oil according to claim 12, wherein the sulfur additive is one or a combination of compounds selected from the group consisting of sulfurized sperm oil, sulfurized pinene oil, sulfurized soybean oil, sulfurized polyolefin, dialkyl disulfide, dialkyl polysulfide, dibenzyl disulfide, ditertiarybutyl disulfide, polyolefin polysulfide, bisalkylpolysulfanylthiadiazole, sulfurized phenol, zinc dithiocarbamate, lead dithiocarbamate, and antimony dithiocarbamate.

15. A lubricating oil according to claim 1, further comprising 0.2 to 0.5% by weight of a phenolic antioxidant having an ester group.

16. A lubricating oil for internal combustion engine comprising:

(a) a mineral oil and/or a synthetic lubricating oil as a base oil;

(b) an oxymolybdenum dithiocarbamate sulfide of the chemical formula (1):

(1)

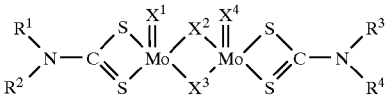

in an amount of 0.005 to 0.2% by weight of molybdenum, wherein $X_1$ to $X_4$ independently are an oxygen atom or a sulfur atom, $R_1$ is a branched alkyl group having 14 or more carbon atoms, and $R_2$ to $R_4$ independently are a branched alkyl group having 4 or more carbon atoms;

(c) a sulfur-based additive represented by the chemical formula (5):

(5)

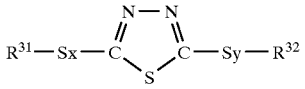

in an amount of 0.01 to 0.5% by weight of sulfur, wherein $R^{31}$ and $R^{32}$ independently are a hydrocarbon group having 3–18 carbon atoms and x and y are integers from 2 to 5; and (d) 0.2 to 5.0% by weight of a phenol-type antioxidant having an ester group represented by the chemical formula (6):

(6)

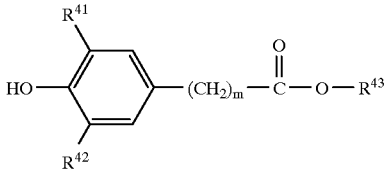

wherein m is an integer from 1 to 3, $R^{41}$ and $R^{42}$ independently are a linear or branched hydrocarbon group having 1 to 12 carbon atoms, and $R^{43}$ is a hydrocarbon group having 4 to 50 carbon atoms.

17. The lubricating oil according to claim 16 wherein $R^1$ has a branch point at position 2.

* * * * *